US006505651B2

(12) United States Patent
Debaes et al.

(10) Patent No.: US 6,505,651 B2
(45) Date of Patent: Jan. 14, 2003

(54) DEVICE FOR ADJUSTING THE TENSION IN PILE WARP YARNS IN A FACE-TO-FACE WEAVING MACHINE

(75) Inventors: Johnny Debaes, Moorslede (BE); Ferdi Dejaegere, Dadizele (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 10/106,321

(22) Filed: Mar. 27, 2002

(65) Prior Publication Data

US 2002/0148523 A1 Oct. 17, 2002

(30) Foreign Application Priority Data

Mar. 27, 2001 (BE) ..... 2001/0200

(51) Int. Cl.[7] ..... D03D 39/22
(52) U.S. Cl. ..... 139/21; 139/25
(58) Field of Search ..... 139/21, 25, 26, 139/102

(56) References Cited

U.S. PATENT DOCUMENTS 5,458,160 A * 10/1995 Geiger et al. ..... 139/102
5,722,464 A * 3/1998 Truyen et al. ..... 139/25

FOREIGN PATENT DOCUMENTS

| | | |
|---|---|---|
| DE | 19618557 | 11/1996 |
| DE | 19643190 | 4/1997 |
| GB | 657504 | 9/1951 |

* cited by examiner

*Primary Examiner*—John J. Calvert
*Assistant Examiner*—Robert H. Muromoto, Jr.
(74) *Attorney, Agent, or Firm*—James Creighton Wray; Meera P. Narasimhan

(57) ABSTRACT

A device for adjusting the tension of pile warp yarns in a face-to-face weaving machine comprises a first (14) and a second yarn guiding element (11), the second yarn guiding element (11) adjusting the tension in the pile warp yarns (100) by deflection. A pneumatic system (16) is provided, where the pressure in the pneumatic system (16) determines the deflection of the second yarn guiding element (11) and where the pneumatic system (16) is provided to maintain the pressure at a practically constant value, adjustable via a control system. The device is further provided so that the tension in the pile warp yarns (100) is adjustable by adjusting a certain pressure in the pneumatic system (16).

8 Claims, 3 Drawing Sheets

DEVICE FOR ADJUSTING THE TENSION IN PILE WARP YARNS IN A FACE-TO-FACE WEAVING MACHINE

This application claims the benefit of Belgian Application No. 2001/0200 filed Mar. 27, 2001.

BACKGROUND OF THE INVENTION

The invention relates to a device for adjusting the tension in pile warp yarns in a face-to-face weaving machine, the device comprising a first and a second yarn guiding element, the second yarn guiding element adjusting the tension in the yarn by deflection.

A similar device is already known in face-to-face weaving machines, in which a device is provided between each pile warp yarn beam and the pile supplying cylinder in order to stretch the pile warp yarns. The device consisting here of a cylinder which is rotatable around a hinge shaft to which a second cylinder, rotatable round a hinge shaft, is connected by means of a lever system. The deflection of this second cylinder causes the pile warp yarns to be stretched. This deflection is obtained by tightening a spring, more particularly draw-springs and torsion springs.

The problem of this device is, that because of the known spring rate, with each position of the deflection of the dancer cylinder another tension is built up in the pile warp yarns. The real tension is situated, as it were, with a hysteresis loop around an average value. In weaving machines running at higher speeds, at a start, the pile length is taken up faster per time unit by the pile suppliers and at a stop the decrease of pile warp yarns per time unit is also stopped quicker, so that shocks will occur in the spring system, causing oscillations of the stretching device. Moreover, at each replacement of a pile warp yarn beam the pre-load of the spring system is released, after which, after having tied Up the new pile warp yarn beam, the pre-load of the spring system must be readjusted. This adjustment is done manually and requires the survey or measuring of the elongation or the torsion of the spring, because of which the operations required by this device are time-consuming

SUMMARY OF THE INVENTION

The purpose of this invention is a device for adjusting the tension in pile warp yarns in a device which does not show any of the drawbacks mentioned above.

According to the invention, this purpose is obtained in providing a pneumatic system in which the pressure in the pneumatic system determines the deflection of the second yarn guiding element and in which the pneumatic system is provided to keep the pressure at a practically constant value, adjusted via the control system.

This has the advantage that the hysteresis loop which shows the real tension in the device according to the state of the art, will be reduced and will approach as much as possible the average value adjusted via the control system.

In a preferred embodiment the tension in the pile warp yarns is adjustable by adjusting a certain pressure in the pneumatic system.

On the one hand, this has the advantage that for a well-specified application a well-specified pressure may be adjusted via the control system of the face-to-face weaving machine, which varies, for instance, when using a different type of yarn.

On the other hand this has also the advantage that the tension in the pile warp yarns may be released or reduced for certain operations which have to be carried out on the face-to-face weaving machine, for instance, when changing the pile warp yarn beam.

In a preferred embodiment of the device the pressure in the pneumatic system can be adjusted by means of a valve.

In a more specific preferred embodiment of the device, the valve can be controlled by the control system of the face-to-face weaving machine.

This has the advantage that the tension in the pile warp yarn can be adjusted with a numerical value for the working pressure via the keyboard of the control system of the face-to-face weaving machine.

In a particularly advantageous embodiment of the device, the pneumatic system determines the deflection of the second yarn guiding element via a lever system that is situated between the first and second yarn guiding element.

This has the advantage that the working pressure in the pneumatic system can be maintained at a constant value by means of a regulating valve, regardless of the position of the second guiding element.

In a particularly preferred embodiment of the device, the pressure adjusted in the pneumatic system is readable on the control panel of the face-to-face weaving machine.

This has the advantage that for a certain type of yarn and type of fabric the working pressure can be read exactly and stored in a file containing the adjusting parameters of the face-to-face weaving machine for that type of fabric.

In a more specific preferred embodiment of the device, the pneumatic system works based on compressed air.

This has the advantage that a certain pressure in the delivery pipe can be easily increased to a certain working pressure by means of a regulating valve.

It is an understood thing that these advantages cannot only be obtained in face-to-face weaving machines, but also in other textile machines, for applications with other yarns.

This invention is further clarified in the following non-restrictive description of a preferred embodiment of a pile warp yarn stretching device according to this invention.

BRIEF DESCRIPTION OF THE DRAWINGS

In this description reference is made by means of reference numbers to the attached figures, of which

DETAILED DESCRIPTION OF THE PREFERRED EMBODIMENTS

Figure 1:
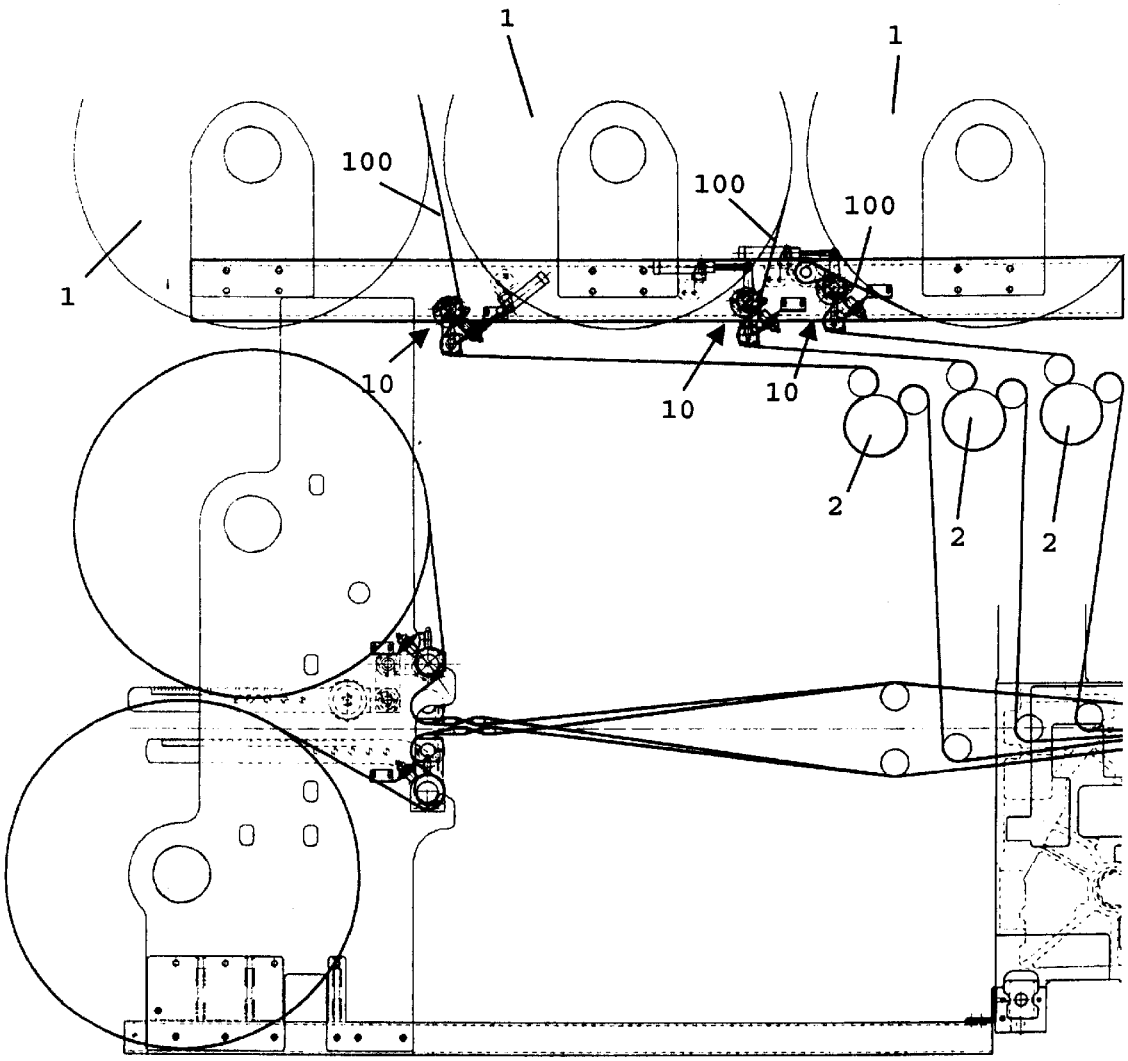
FIG. 1 is a schematic representation of three pile warp yarn beams and pile supplying cylinders in a face-to-face weaving machine, between which a device according to the invention is provided to adjust the tension in the pile warp yarns.

As represented in FIG. 1, a device (10) is provided in a face-to-face weaving machine between each pile warp yarn beam (1) and the pile supplying cylinder (2) in order to stretch the pile warp yarn (100).

Figure 2:
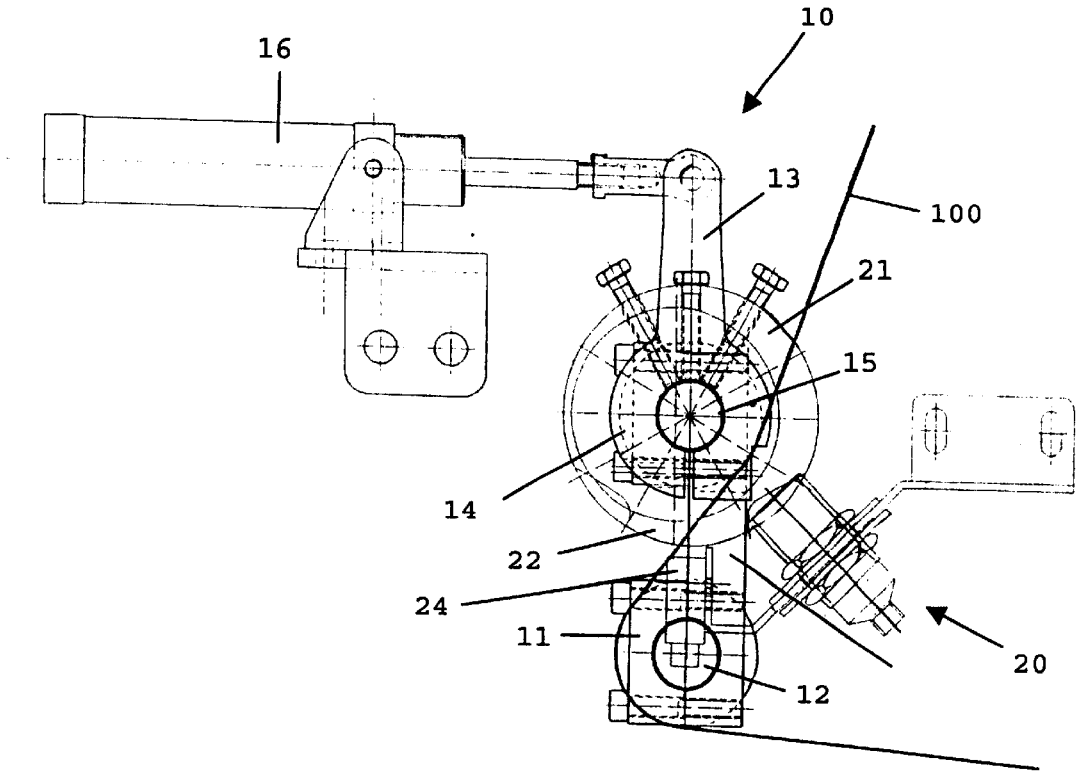
FIG. 2 is a side view of a device according to the invention that is situated between a pile warp yarn beam and a pile supplying cylinder in a face-to-face weaving machine.
Figure 3:
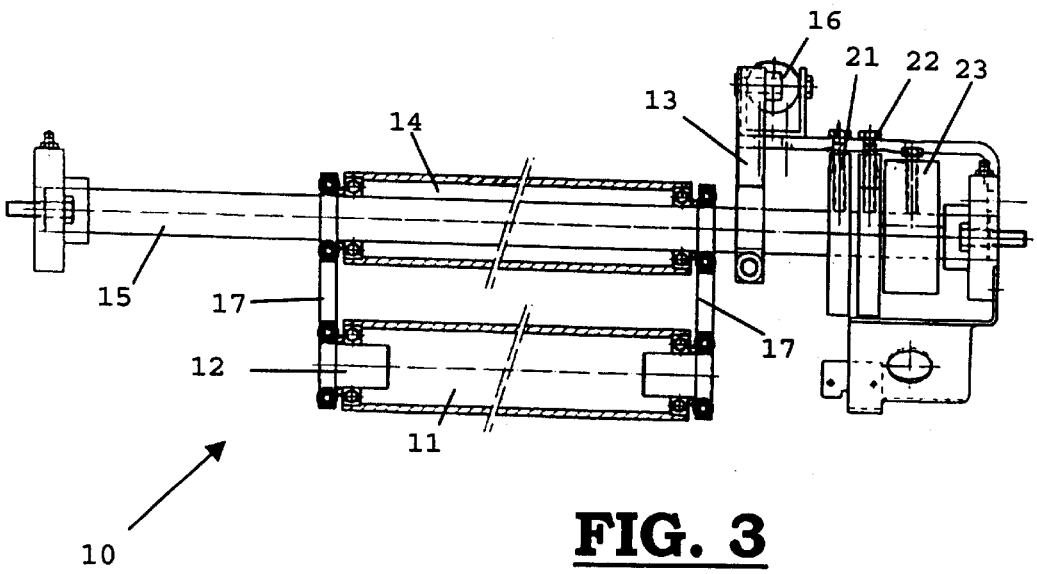
FIG. 3 is a front view of a device according to the invention that is situated between a pile warp yarn beam and a pile supplying cylinder in a face-to-face weaving machine.

As represented in the FIGS. 2 and 3, this device (10) consists of a first yarn guiding cylinder (14) that is mounted rotatably around a first hinge shaft (15). Hinge shaft (15) is rotatably mounted on bearings in the main frames of the face-to-face weaving machine. Via the holders of the second yarn guiding cylinder (17) a second cylinder (11), rotatable around a second hinge shaft (12), is connected to this hinge shaft (15). The deflection of the second cylinder (11) adjusts the tension in the pile warp yarn (100).

This deflection is determined by a pneumatic cylinder with piston (16), which acts as a pneumatic spring. A compressed air regulating valve (not represented in the figure), controlled by the control system of the face-to-face weaving machine, maintains a certain constant pneumatic pressure in the cylinder, so that in case of a deflection of the second yarn guiding cylinder (11) the working pressure adjusted in the cylinder (16) is readjusted, so that the tension in the pile warp yarns (100) remains constant.

Figure 4:
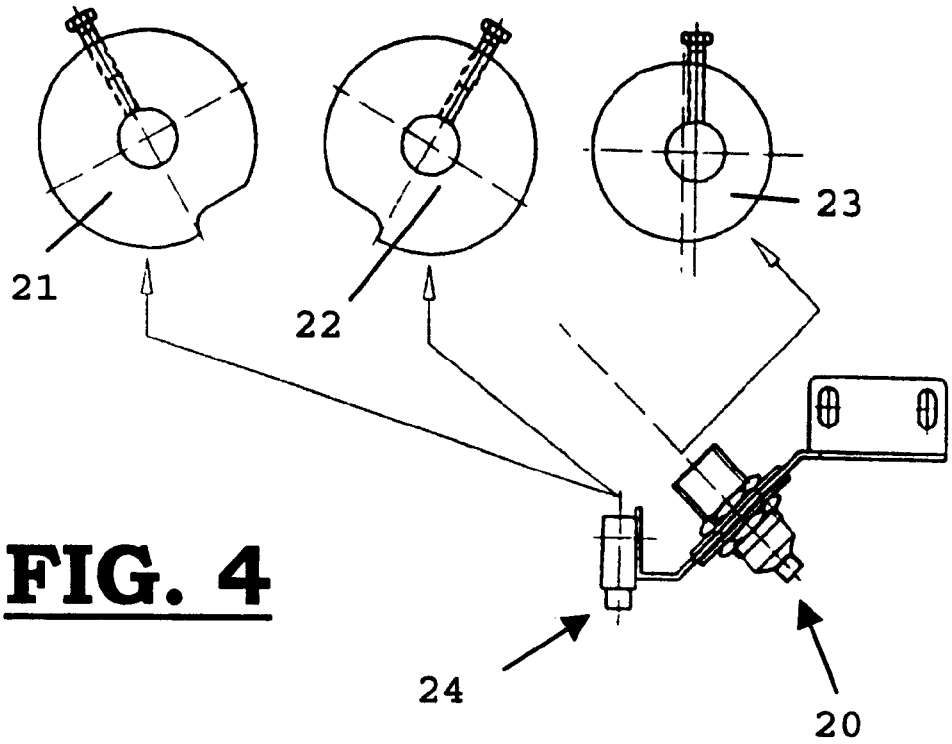
FIG. 4 is a schematic representation of the cams that allow the different deflections of the second yarn guiding cylinder to be detected by means Of proximity sensors.

This pile warp yarn stretching device (10) serves as a dancer device for the regulating system of the pile warp beam release, as represented in FIG. 4. If, because of its great inertia, the pile warp yarn beam (1) is somewhat slow at the start of the face-to-face weaving machine and therefore more pile warp yarn (100) is supplied than reeled off, then the pile warp yarn (100) is taken from the buffer angle of contact of the pile warp yarn stretching device (10) and the second yarn guiding cylinder (11), under the influence of the pneumatic cylinder, starts deflecting towards the pile supplying cylinders (2). The air in the pneumatic cylinder (16) is compressed, because of which the pressure in the cylinder starts increasing, with the result that compressed air should escape from the compressed air valve in order to regain a constant pressure. However, on the contrary, if the pile warp yarn beam (1), because of its own inertia, comes to a halt too late, for instance, when the face-to-face weaving machine stops, and therefore too much pile warp yarn (100) is reeled off, then the pile warp yarn (100) is stored in a buffer angle of contact and the second yarn guiding cylinder (11) deflects away from the pile supplying cylinders (2) under the influence of the pneumatic cylinder. The compressed air in the pneumatic cylinder (16) starts expanding because of which the pressure in the pneumatic cylinder (16) drops, and because of which consequently air must be supplied via the air pressure regulating valve in order to regain a constant pressure.

When during weaving, for a short period, no pile warp yarn is used during one or more rotations of the weaving machine, for instance, when weaving pile blanks, then the pile supplier is stopped, but not the pile warp release. The quantity reeled off is buffered in the pile warp yarn stretching device (10). Pile warp yarn beams (2) namely have a diameter of up to 1500 mm and consequently have a great polar moment of inertia, so that a start or stop for the duration of one rotation of the face-to-face weaving machine is excluded.

As also may be seen in the FIGS. 2 and 3, there are two sensors (20, 24) present, which are checking the position of the lever (13). The sensor (20) is linear and is damped by a first cam (23) that is situated before the sensor (20). This sensor (20) regulates the warp yarn release and therefore causes the pile warp yarn release to be faster or slower. The sensor (24) checks the pile release. The sensor (24) has two damping faces that act together with cams (21, 22 respectively). In the normal position of FIG. 4 both sensor faces (24) are damped.

In case an extreme position is detected, for instance, if the pile warp yarn (100) is reeled off too much or too little, then one of the two faces of the sensor (20, 24) will not be damped and this will stop the face-to-face weaving machine and report the cause of the stoppage.

This device works efficiently at high weaving speed without any harmful oscillations. The working pressure in the compressed air cylinder can be adjusted or released by the control system, so that by just pressing the button the weaving machine is immediately ready for a change of the pile warp yarn beam. Thereafter, the tension in the pile warp yarns also can be readjusted by just pressing the button. This adjusted value can be read on the control panel of the face-to-face weaving machine at any time. If a working pressure for a certain type of fabric was determined experimentally, it can be stored in the parameter file of the adjustment of the face-to-face weaving machine for that specific type of fabric.

What is claimed is:

1. A face-to-face weaving machine comprising a device to adjust tension in pile warp yarns in the face-to-face weaving machine, the device comprising a first and a second yarn guiding element, the second yarn guiding element adjusting the tension of the pile warp yarn by deflection, a pneumatic system with adjustable pressure for determining a deflection of the second yarn guiding element and for maintaining the pressure continuously at a practically constant value, and a control system for adjusting the pressure.

2. Device according to claim 1, wherein the tension in the pile warp yarn is adjustable by adjusting the pressure in the pneumatic system.

3. Device according to claim 1, further comprising a valve for adjusting the pressure in the pneumatic system.

4. Device according to claim 3, wherein the valve is controlled by the control system of the face-to-face weaving machine.

5. Device according to claim 1, further comprising a lever system disposed between the first and the second yarn guiding systems and wherein the pneumatic system determines the deflection of the second yarn guiding element via the lever system.

6. Device according to claim 1, wherein the control system comprises a control panel for displaying a working pressure of the pneumatic system and wherein the working pressure adjusted in the pneumatic system is read on the control panel of the face-to-face weaving machine.

7. Device according to claim 6, further comprising a set-up file in the face-to-face weaving machine, wherein a set-up value of the working pressure is stored in the set-up file of the face-to-face weaving machine corresponding to a certain fabric of interest.

8. Device according to claim 1, wherein the pneumatic system is actuated by compressed air.

* * * * *